US006235445B1

(12) United States Patent
Nakamura et al.

(10) Patent No.: US 6,235,445 B1
(45) Date of Patent: May 22, 2001

(54) THERMAL TRANSFER SHEET

(75) Inventors: Hideyuki Nakamura; Yonosuke Takahashi, both of Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/291,743

(22) Filed: Apr. 14, 1999

(30) Foreign Application Priority Data

Apr. 15, 1998 (JP) ..... 10-105185

(51) Int. Cl.[7] ..... B41M 5/025

(52) U.S. Cl. ..... 430/200; 428/195; 428/473.5; 428/913; 428/914; 430/945

(58) Field of Search ..... 428/195, 913, 428/914, 473.5; 430/945, 200

(56) References Cited

U.S. PATENT DOCUMENTS 5,619,243 * 4/1997 Hotta et al. ..... 347/139

* cited by examiner

*Primary Examiner*—Bruce H. Hess
(74) *Attorney, Agent, or Firm*—Sughrue, Mion, Zinn, Macpeak & Seas, PLLC

(57) ABSTRACT

The present invention provides a thermal transfer sheet comprising a substrate, and a light-to-heat conversion layer containing a substance capable of converting light to heat and a binder, and an image forming layer, which are disposed on the substrate, wherein the binder in the light-to-heat conversion layer is a polyimide resin soluble in an organic solvent. In the thermal transfer sheet provided by the present invention, the light-to-heat conversion layer is not affected by the coating liquid disposed as a layer on the light-to-heat conversion layer. Further, the light-to-heat conversion layer thus formed exhibits high heat resistance and humidity resistance. Accordingly, the thermal transfer sheet of the present invention produces good images with little or no fogging.

16 Claims, No Drawings

THERMAL TRANSFER SHEET

BACKGROUND OF THE INVENTION

1. Field of the Invention

The present invention relates to a thermal transfer sheet for use in an imaging process wherein a high-resolution image is formed by using a laser light. More specifically, the present invention relates to a thermal transfer sheet that can be used in an imaging process for preparation of a color proof (DDCP: direct digital color proof) or of a mask image, in printing with laser recording from digital image signals.

2. Description of the Related Art

In the field of graphic art, an image is printed on a printing plate by using a set of color-separation films prepared from a color original by using lithographic films. And, usually, a color proof is prepared from the color-separation films in order to check for any errors in a color separation process or for the necessity of color correction before a final printing (i.e., actual printing) process. The color proof is desired to have the capability of actualizing high resolution which enables a high-fidelity reproduction of halftone images, as well as a high level of process stability, and the like. In addition, in order to obtain a color proof approximating actual printed matter, the materials for the color proof are desirably the same materials as those for the actual printed matter. For example, the substrate of the color proof is desired to be the printing paper for use in the printed matter and the coloring materials of the color proof are desired to be pigments. Further, it is highly desired to adopt a dry process, which does not use a liquid developer, as a method for the preparation of the color proof.

As for the dry-process preparation method of the color proof, a recording system, capable of preparing the color proof directly from digital signals, has been developed as a result of the wide spread use of an electronically controlled system in recent pre-printing processes (pre-press field). In such an electronically-controlled system, the preparation of a color proof of a particularly high quality is necessary, and therefore the reproduction of halftone dots having 150 lines per inch or more is generally required. And, in order to record a high-quality proof from digital signals, it is necessary to use, as a recording head, a laser light that can be modulated by the digital signals and can be focused to a small concentrated spot. Accordingly, there is a demand for a recording material that exhibits a high recording sensitivity with respect to the laser light and a high resolution enabling the reproduction of highly precise and fine halftone dots.

As for a recording material for an imaging process by transfer using a laser light, hitherto known is a heat-fusion type transfer sheet (described in Japanese Patent Application Laid-Open (JP-A) No. 5-58,045) comprising a substrate, a light-to-heat conversion layer which generates heat by absorbing the laser light, and an image forming layer which has a pigment dispersed in a component such as a heat-sensitive fusible wax, a binder or the like, disposed in that order on the substrate. According to this imaging process using these recording materials, heat generated in a region irradiated with the laser light in the light-to-heat conversion layer fuses the image forming layer correspondingly to the irradiated region so that the fused layer is transferred to an image receiving sheet disposed on the transfer sheet. In this way, a transferred image is formed on the image receiving sheet.

In addition, JP-A No. 6-219,052 discloses an imaging process using a thermal transfer sheet comprising a substrate, a light-to-heat conversion layer containing a substance capable of converting light to heat, a very thin (0.03~0.3 $\mu$m) heat-sensitive peelable layer, and an image forming layer containing a coloring material, disposed in that order on the substrate, wherein, upon irradiation with a laser light, the interposed heat-sensitive peelable layer diminishes the adhesion between the image forming layer and the light-to-heat conversion layer. In this way, a highly precise, fine image is formed on the image receiving sheet disposed on the thermal transfer sheet. This imaging process utilizes a so-called "abrasion". More specifically, in the region irradiated with the laser light, part of the heat-sensitive peelable layer is decomposed and vaporized. As a result, the adhesion between the image forming layer and the light-to-heat conversion layer decreases so that the image forming layer in the irradiated region is transferred to the image receiving sheet disposed on the thermal transfer sheet.

The above-mentioned imaging processes are advantageous in that a printing paper having formed thereon a receptor layer (bonding layer) can be used as a material for the image receiving sheet and in that a multicolor image can be easily obtained by sequentially transferring images of different colors to the image receiving sheet. In particular, the imaging process using abrasion is advantageous in that a highly precise, fine image can be easily obtained and is therefore useful for the preparation of a color proof (DDCP :direct digital color proof) or a highly precise, fine mask image.

The layers of the thermal transfer sheet for use in the above-mentioned imaging processes are formed by sequentially coating the layers on a substrate. Therefore, the layers need to be formed easily. In addition, the binder for the formation of the light-to-heat conversion layer, which comprises a substance capable of converting light to heat (usually a dye capable of absorbing laser light) and a binder, needs to have, for example, a capability of easily dispersing therein the substance capable of converting light to heat and excellent heat resistance. Traditionally, examples of the binder for the light-to-heat conversion layer include homopolymers or copolymers of acrylic monomers such as acrylic acid; cellulosic polymers such as cellulose acetate; vinyl-based polymers such as polystyrene, vinyl chloride/vinyl acetate copolymers, polyvinyl butyral, and polyvinyl alcohol; polymers made by polycondensation such as polyesters and polyamides; rubber-based thermoplastic polymers such as butadiene/styrene copolymers; polyurethanes; epoxy resins; and urea/melamine resins, as described in, e.g., JP-A Nos. 5-58,045and 6-219,052. Among these polymers, polymers such as polyvinyl alcohol, polyvinyl butyral, and polyesters, are ordinarily preferable.

According to studies conducted by the present inventors, however, disadvantages of the prior art are as follows. The light-to-heat conversion layer, which uses a water-soluble polymer such as polyvinyl alcohol, is generally inferior in humidity resistance and therefore sometimes caused dyes to agglomerate during storage for a long period of time under conditions of high temperature and high humidity. On the other hand, if a resin, which is less liable to cause the above-mentioned phenomenon and which is exemplified by polyvinyl butyral, a polyester resin or the like, was used for forming of the light-to-heat conversion layer, the light-to-heat conversion layer was moistened by a solvent contained in a coating liquid for forming a heat-sensitive peelable layer, to be coated on the light-to-heat conversion layer, or alternatively by a solvent contained in a coating liquid for forming an image forming layer, to be coated on the light-to-heat conversion layer. As a result, the dye in the light-to-heat conversion layer was transferred to these other layers, and sometimes the performance (e.g., sensitivity) of the light-to-heat conversion layer was worsened or fogging occurred. In addition to these disadvantages, since the heat resistance of these polymers was insufficient, these polymers were liable to cause thermal decomposition and adhesion due to fusion. As a result, a portion of the light-to-heat conversion layer was transferred together with the image forming layer, which sometimes inhibited preparation of a satisfactory image or presented an impediment to a transfer operation.

Accordingly, an object of the present invention is to provide a thermal transfer sheet whose light-to-heat conversion layer is not affected by the coating liquids for forming layers thereon and has a high level of heat resistance and humidity resistance, and which produces a good transferred image with minimal fogging.

SUMMARY OF THE INVENTION

The present inventors have conducted studies in pursuit of a binder suited for use in a light-to-heat conversion layer. According to the studies, if the light-to-heat conversion layer is formed from a polyimide resin having excellent heat resistance, the light-to-heat conversion layer is not dissolved by a solvent contained in a liquid forming a layer (i.e., an image forming layer or a heat-sensitive peelable layer) on the light-to-heat conversion layer. Therefore, impairment of performance of the light-to-heat conversion layer by dye transfer or fogging does not occur. In addition, excellent heat resistance of the light-to-heat conversion layer makes it possible to prevent obstruction of transfer. Although the use of a polyimide resin as the binder has been hitherto known, the solubilities of conventional polyimide resins in solvents are so poor that high temperature conditions, such as melt extrusion, are always necessary for formation of films of conventional polyimide resins. However, in contrast with conventional polyimide resins, a polyimide resin used in the present invention has a sufficient solubility in a solvent. Therefore, the present invention makes it possible to form a layer containsing a substance capable of converting light to heat but susceptible to decomposition at high temperatures, without decomposing the substance capable of converting light to heat.

The thermal transfer sheet of the present invention comprises a substrate, and a light-to-heat conversion layer containing a substance capable of converting light to heat and a binder, and an image forming layer, which are disposed on the substrate, wherein the binder in the light-to-heat conversion layer is a polyimide resin soluble in an organic solvent, preferably comprising a structure represented by any of the following formulae (I), (II), (III), (IV), (V), (VI) and (VII):

(I)

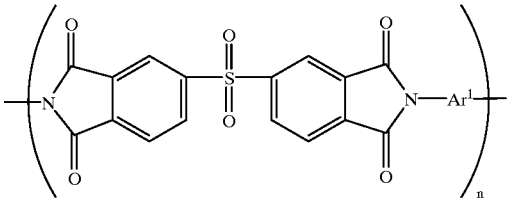

-continued (II)

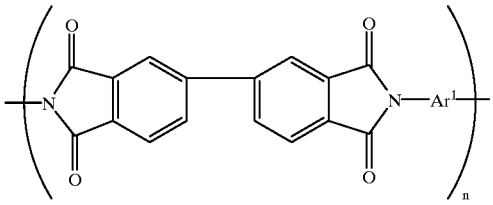

wherein $Ar^1$ represents an aromatic group represented by any of following formulae (1)~(3); and n is an integer of from to 100:

(1)

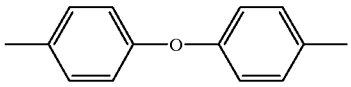

(2)

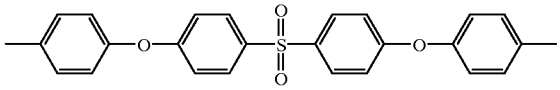

(3)

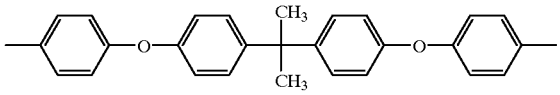

(III)

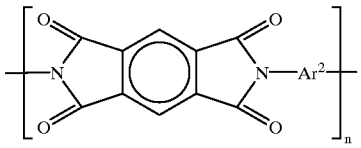

(IV)

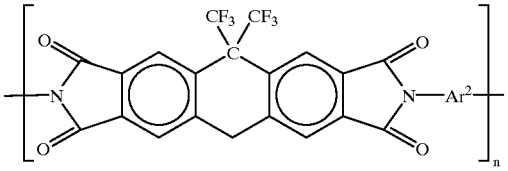

wherein $Ar^2$ represents an aromatic group represented by any of the following formulae (4)~(7); and n is an integer of from 10 to 100:

(4)

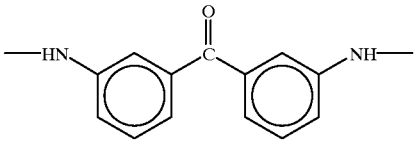

(5)

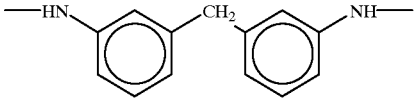

(6)

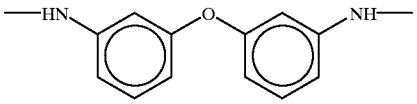

(7)

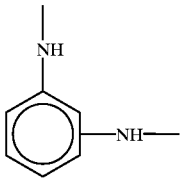

(V)

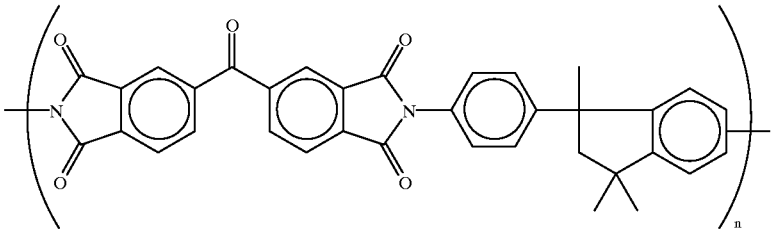

(VI)

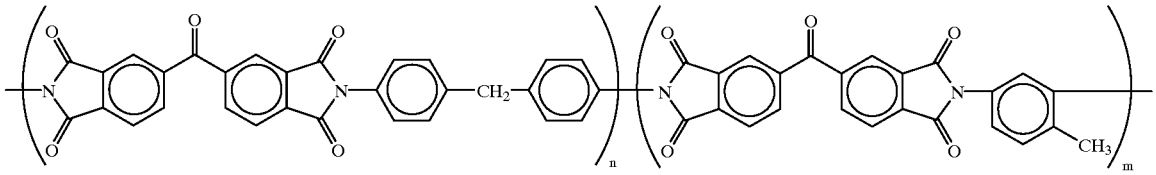

(VII)

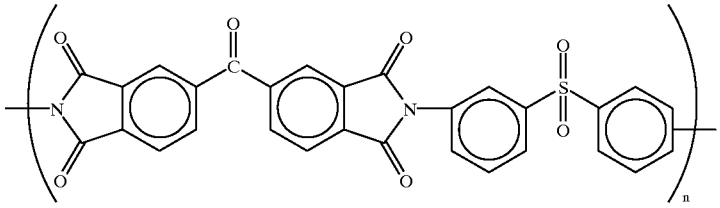

Wherein n and m represent integers from 10 to 100, and the ratio n:m is in the range from 6:4 to 9:1.

In the thermal transfer sheet of the present invention, the light-to-heat conversion layer comprises the polyimide resin and so is hardly affected by the coating liquid disposed as a layer on the light-to-heat conversion layer. Further, the light-to-heat conversion layer thus formed exhibits high heat resistance and humidity resistance. Accordingly, use of the thermal transfer sheet of the present invention is not associated with obstructing image transfer, and makes possible production of a good transferred image free of fogging.

DETAILED DESCRIPTION OF THE PREFERRED EMBODIMENTS

Materials forming a thermal transfer sheet of the present invention are described below.

A material for a substrate is not particularly limited. Therefore a variety of materials can be used according to purpose. Preferred examples of the material for the substrate include synthetic materials such as polyethylene terephthalate, polyethylene-2-6-naphthalate, polycarbonate, polyethylene, polyvinyl chloride, polyvinylidene chloride, polystyrene, and styrene/acrylonitrile copolymers. Among these materials, biaxially stretched polyethylene terephthalate is most preferable from a standpoint of mechanical strength and dimensional stability with respect to heat. The substrate of the thermal transfer sheet of the present invention is preferably made of a transparent, laser light-transmitting synthetic resin, in cases in which the thermal transfer sheet of the present invention is used for preparation of a color proof utilizing a laser light for recording.

In order to improve adhesion of the substrate of the thermal transfer sheet to the light-to-heat conversion layer to be disposed on the substrate, it is preferable to carry out a surface activation treatment of the substrate and/or to form on the substrate one layer or two or more layers of a primer. Examples of the surface activation treatment include a glow discharge treatment and a corona discharge treatment. Preferable as a material for the primer is a material that exhibits good adhesiveness to surfaces of both the substrate and the light-to-heat conversion layer, has a small thermal conductivity and has excellent heat resistance. Examples of such materials for the primer include polystyrene, a styrene/butadiene copolymer, and gelatin. The total thickness of the primer layer is ordinarily in the range of from 0.01 to 2 $\mu$m. In addition, if necessary, a surface of a side opposite to a side having the light-to-heat conversion layer may be provided with a functional layer, such as a anti-reflection layer or the like, or otherwise may be surface-treated.

A substance capable of converting light to heat for use in the light-to-heat conversion layer to be formed on the substrate is usually a coloring material (i.e., a pigment or the like) capable of absorbing a laser light. Example of the coloring material (i.e., a pigment or the like) include: a black pigment such as carbon black; a pigment such as phthalocyanine, naphthalocyanine or the like, made up of a macrocyclic compound capable of absorbing rays in regions ranging from a visible region to a near infrared region; an organic dye, such as a cyanine dye exemplified by an indolenine dye, an anthraquinone-based dye, an azulene-based dye, phthalocyanine-based dye, or the like, for use as a laser-absorbing material for high-density laser recording in an optical disk or the like; and a dye composed of an organometallic compound such a dithiol /nickel complex or the like. Preferably, in order to increase recording sensitivity, the light-to-heat conversion layer is as thin as possible. For this reason, it is preferable to use a cyanine-based dye or a phthalocyanine-based dye, which have large light absorption coefficients in a region of laser light wavelengths. An inorganic material, such as a metallic material, can also be used as a laser light-absorbing material in the light-to-heat conversion layer. The metallic material is used in particle form (e.g., photographic silver).

A polyimide resin for use in the light-to-heat conversion layer is a polyimide resin that is soluble in a solvent and preferably comprises a structure represented by one of the following formulae (I), (II), (III), (IV), (V), (VI) and (VII):

(I)

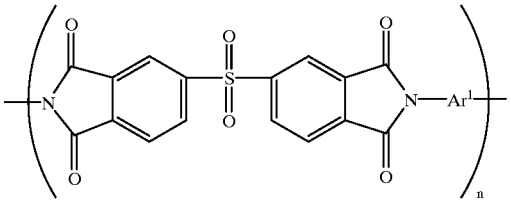

(4)

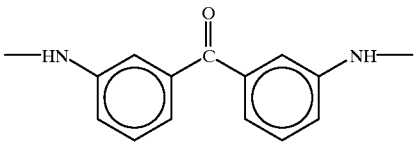

-continued (II)

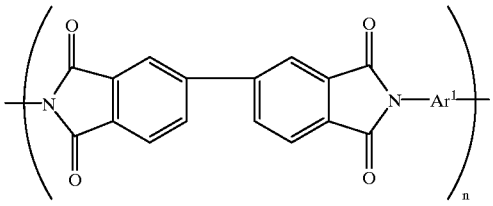

wherein $Ar^1$ represents an aromatic group represented by one of the following formulae (1)~(3); and n is an integer of from 10 to 100:

(1)

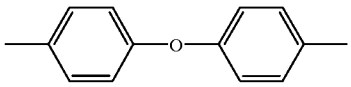

(2)

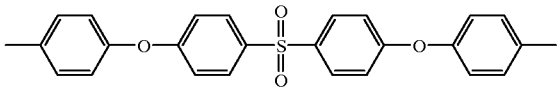

(3)

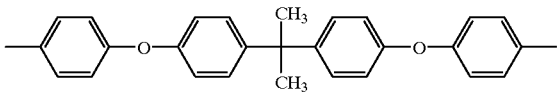

(III)

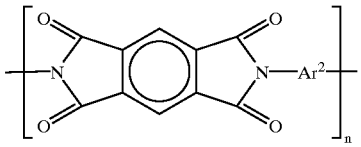

(IV)

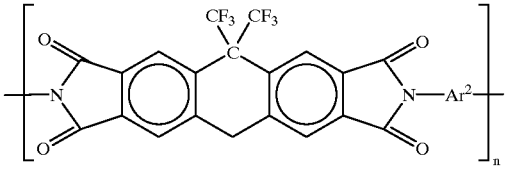

wherein $Ar^2$ represents an aromatic group represented by one of the following formulae (4)~(7); and n is an integer of from 10 to 100.

(5)

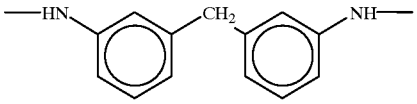

-continued (6)

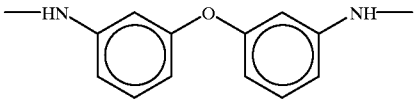

(7)

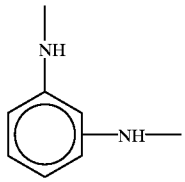

(V)

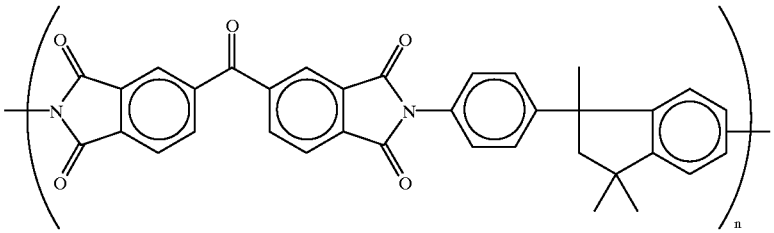

(VI)

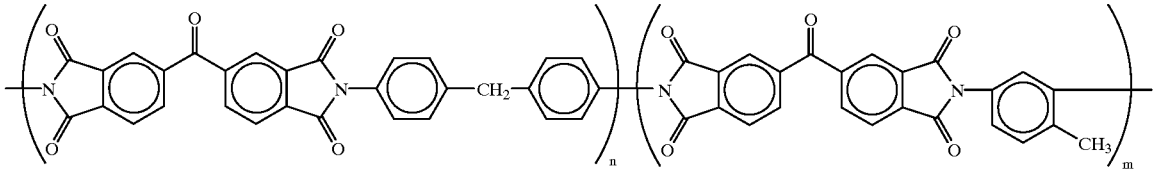

(VII)

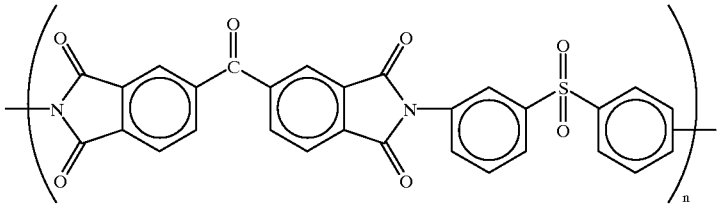

Wherein n and m represent integers from 10 to 100, and the ratio n:m is in the range from 6:4 to 9:1.

In the present invention, 5 parts by weight or more, and more preferably 15 parts by weight, particularly preferable 100 parts by weight, of the soluble polyimide resin dissolves in 100 parts by weight of N- methylpyrrolidone at 25° C.

In addition, the glass transition temperature of the polyimide resin is preferably in the range of from 200 or more to 400 or less ° C. Further, the temperature at which 5% weight loss of the polyimide resin is observed by TDA is preferably 450° C. or more.

Examples of the polyimide resin soluble in an organic solvent suited for use in the present invention include XU-218 (TM) (manufactured by Ciba-Geigy), Upilex (TM) (manufactured by Ube Kosan), DSDA/BAPS (TM) (manufactured by Shin Nihon Rika), PI 2080(TM) (manufactured by Upjohn), and PISO(TM) (manufactured by Celanese).

The light-to-heat conversion layer can be formed by a process comprising preparing a coating liquid by dissolving the substance capable of converting light to heat and the polyimide resin in an organic solvent, coating the coating liquid on the surface of the substrate, and then drying the coating layer. Examples of the solvent for dissolving the polyimide resin include 1,4-dioxane, 1,3-dioxolane, dimethyl acetate, N-methyl-2-pyrrolidone, dimethylsulfoxide, dimethylformamide, and γ-butyrolactone. A coating operation and a drying operation can be respectively carried out by conventional methods. Drying is ordinarily conducted at or below 300° C., and preferably at or below 200° C. More preferably, the drying temperature is in a range of from 80 to 150° C., if polyethylene terephthalate is used as the substrate.

In the light-to-heat conversion layer thus formed, the solids-based weight ratio of the coloring material (dye stuff or pigment) to the polyimide resin as the binder (i.e., coloring material: binder) is preferably in a range of from 1:20 to 2:1, and more preferably in a range of from 1:10 to 2:1. If the amount of the binder is too small, the cohesive strength of the light-to-heat conversion layer is so small that the light-to-heat conversion layer is liable to be transferred together with the image and thus tends to cause color mixing when the image formed is transferred to an image receiving sheet. On the other hand, if the amount of the binder is too large, sensitivity tends to decrease, because the light-to-heat conversion layer becomes thicker in order to attain a fixed light absorption ratio. The thickness of the light-to-heat conversion layer is preferably in a range of from 0.03 to 0.8 μm, and more preferably in a range of from 0.05 to 0.3 μm. Further, the light-to-heat conversion layer preferably has a peak absorbance (optical density) ranging preferably from 0.1 to 1.3, more preferably from 0.2 to 1.1, in a wavelength region of from 700 to 2000 nm.

The heat resistance (e.g., thermal deformation temperature or thermal decomposition temperature) of the binder of the light-to-heat conversion layer is required to be higher than that of the material for the layer to be formed on the light-to-heat conversion layer. This requirement can be fulfilled in the present invention by use of the polyimide resin as the binder of the light-to-heat conversion layer. In addition, the use of the polyimide resin as the binder makes it possible to minimize changes in viscosity over time and to improve humidity resistance, and storage stability over long periods of time.

A heat-sensitive peelable layer, may be disposed on the light-to-heat conversion layer of the thermal transfer sheet of the present invention wherein the heat-sensitive peelable layer includes a heat-sensitive substance that generates a gas or releases water or the like by the action of heat generated in the light-to-heat conversion layer, and thus decreases the strength of adhesion between the light-to-heat conversion layer and an image forming layer. Examples of the heat-sensitive substance include: a compound (a polymer or a compound having a low molecular weight) which itself is decomposed or transformed by the action of heat to thereby generate a gas; and a compound (a polymer or a compound having a low molecular weight) which contains by way of absorption or adsorption a considerable amount of an easily vaporizable liquid such as water. These substances may be used in combination.

Examples of the polymer, decomposed or transformed by the action of heat to thereby generate a gas, include: a self-oxidizable polymer such as nitrocellulose; a halogen-containing polymer, such as chlorinated polyolefin, chlorinated rubber, polychlorinated rubber, polyvinyl chloride, polyvinylidene chloride, or the like; an acrylic polymer, such as polyisobutyl methacrylate, having a volatile compound, e.g., water, adsorbed thereto; a cellulose ester, such as ethyl cellulose, having a volatile compound, e.g., water, adsorbed thereto; and a naturally occurring polymeric compound, such as gelatin, having a volatile compound, e.g., water, adsorbed thereto. Examples of the compound which has a low molecular weight and which is decomposed or transformed by the action of heat to thereby generate a gas include compounds that undergo an exothermic decomposition to thereby generate a gas, such as diazo compounds and azides. The temperature at which the decomposition or transformation by the action of heat occurs is preferably 280° C. or below, and particularly preferably 230° C. or below.

If a compound having a low molecular weight is used as a heat-sensitive substance of the heat-sensitive peelable layer, it is preferable to use the compound together with a binder. Examples of the binder include the above-mentioned polymer, which itself is decomposed or transformed by the action of heat to thereby generate a gas, or may be an ordinary polymeric binder lacking this property. Where the heat-sensitive compound having a low molecular weight is used together with the binder, the weight ratio of the former to the latter is preferably in a range of from 0.02:1 to 3:1, and more preferably in a range of from 0.05:1 to 2:1. Preferably, the heat-sensitive peelable layer covers substantially the entire surface of the light-to-heat conversion layer. The thickness of the heat-sensitive peelable layer is generally in a range of from 0.03 to 1 $\mu$m, and preferably in a range of from 0.05 to 0.5 $\mu$m. If the thermal transfer sheet comprises the substrate, the light-to-heat conversion layer, the heat-sensitive peelable layer, and the image forming layer, disposed in that order on the substrate, the heat-sensitive peelable layer is decomposed or transformed by the action of the heat transmitted from the light-to-heat conversion layer, and, as a result, a gas is generated. The decomposition or the generation of gas causes a portion of the heat-sensitive peelable layer to disappear, or disrupts cohesion within the heat-sensitive peelable layer. As a result, the strength of adhesion between the light-to-heat conversion layer and the image forming layer diminishes. Accordingly, depending on the behavior of the heat-sensitive peelable layer, a portion of the heat-sensitive peelable layer may undesirably adhere to the image forming layer and appear on the finally formed image, thus causing color mixing. Because of this, in order to ensure that color mixing is not visually discernible in the image formed even if the above-mentioned transfer of the heat-sensitive peelable layer takes place, the heat-sensitive peelable layer is preferably almost colorless (i.e., highly transmissive to visible light). Specifically, the light absorption coefficient of the heat-sensitive peelable layer is 50% or less, preferably 10% or less, with respect to visible light.

Instead of forming the heat-sensitive peelable layer, the light-to-heat conversion layer may contain the heat-sensitive substance and function as a heat-sensitive peelable layer as well.

According to the thermal transfer sheet of the present invention, the image forming layer is disposed on the light-to-heat conversion layer or the heat-sensitive peelable layer. The image forming layer contains a pigment and an amorphous, organic polymer.

Pigments can be roughly divided into organic pigments and inorganic pigments. Organic pigments provide highly transparent films, while inorganic pigments are generally excellent in hiding power. When the thermal transfer sheet of the present invention is used for color correction of prints, pigments suited for use in the thermal transfer sheet are organic pigments whose hues are identical or close to yellow, magenta, cyan, and black, respectively, which are generally used in printing ink. In addition to these pigments, metal powders, fluorescent pigments, and the like may also be used. Examples of the pigments suited for use in the thermal transfer sheet include azo-based pigments, phthalocyanine-based pigments, anthraquinone-based pigments, dioxazine-based pigments, quinacridone-based pigments, isoindolinone-based pigments, and nitro-based pigments. Typical pigments according to hue are given below.

1) Yellow pigments

Hansa Yellow G, Hansa Yellow 5G, Hansa Yellow 10G, Hansa Yellow A, Pigment Yellow L, Permanent Yellow NCG, Permanent Yellow FGL, Permanent Yellow HR;

2) Red pigments

Permanent Red 4R, Permanent Red F2R, Permanent Red FRL, Lake Red C, Lake Red D, Pigment Scarlet 3B, Bordeaux 5B, Alizarin Lake, Rhodamine Lake B;

3) Blue pigments

Phthalocyanine blue, Victoria Blue Lake, Fast Sky Blue;

4) Black pigments

Carbon black

Examples of the amorphous resin, contained in the image forming layer of the thermal transfer sheet of the present invention and having a softening point in a range of from 40 to 150° C., include: butyral resins; polyamide resins; polyethyleneimine resins; sulfonamide resins; polyesterpolyol resins; petroleum resins; homopolymers or copolymers of styrene, a derivative thereof or substituted styrene, such as styrene, vinyltoluene, α-methylstyrene, 2-methylstyrene, chlorostyrene, vinylbenzoic acid, sodium vinylbenzenesulfonate, and aminostyrene; homopolymers or copolymers of vinyl monomers such as methacrylates or methacrylic acid (such as methyl methacrylate, ethyl methacrylate, butyl methacrylate, and hydroxyethyl methacrylate), acrylates or acrylic acid (such as methyl acrylate, ethyl acrylate, butyl acrylate, and 2-ethylhexyl acrylate), dienes (such as butadiene and isoprene), acrylonitrile, vinyl ether, maleic acid, maleic acid esters maleic anhydride, cinnamic acid, vinyl chloride, and vinyl acetate. These resins may be used in a combination of two or more.

In the present invention, the image forming layer comprises 30 to 70% by weight, preferably 40 to 60% by weight, of a pigment and comprises 70 to 30% by weight, preferably 60 to 40% by weight, of an amorphous, organic polymer.

If a plurality of image layers (image forming layers having images formed therein) are stacked sequentially on the same image receiving sheet to prepare a multicolor image, a plasticizer is preferably included in the image forming layers in order to increase adhesion between the images. Examples of the plasticizer include: phthalates such as dibutyl phthalate, di-n-octyl phthalate, di(2-ethylhexyl) phthalate, dinonyl phthalate, dilauryl phthalate, butyllauryl phthalate, and butylbenzyl phthalate; esters of aliphatic divalent acids, such as di(2-ethylhexyl) adipate and di(2-ethylhexyl) sebacate; triesters of phosphoric acid, such as tricresyl phosphate and tri (2-ethylhexyl) phosphate; polyol polyesters, such as polyethylene glycol esters; and epoxy compounds such as esters of epoxidized fatty acids. In addition to these ordinary plasticizers, acrylates, such as polyethylene glycol dimethacrylate, 1,2,4-butanetriol trimethacrylate, trimethylolethane triacetate, pentaerythritol triacrylate, pentaerythritol tetraacrylate, and dipentaerythritol polyacrylate, are also suited for use in the present invention depending on the type of the binder used. These plasticizers may be used in a combination of two or more.

Where the plasticizer is used in the image forming layer, the weight ratio of the combined amount of the pigment and the amorphous, organic polymer to the amount of the plasticizer is generally in a range of from 100:1 to 100:3, and preferably in a range of from 100:2 to 100:1.5. In addition to the above-mentioned components, a surfactant, a thickener, and the like may be added to the image forming layer, if necessary. The thickness (dry layer thickness) of the image forming layer is in a range of from 0.2 to 1.5 $\mu$m, and preferably in a range of from 0.3 to 1.0 $\mu$m.

In order to prevent the image forming layer from becoming scratched, the image receiving sheet or a protective covering film (e.g., polyethylene terephthalate sheet, polyethylene sheet, or the like) is disposed on the surface of the image forming layer.

Ordinarily, the image receiving sheet comprises an ordinary substrate in the form of a sheet, such as a plastic sheet, a metal sheet, a glass sheet, paper, or the like, with one, or two or more, receptor layers provided thereon. Examples of the plastic sheet include polyethylene terephthalate sheets, polycarbonate sheets, polyethylene sheets, polyvinyl chloride sheets, polyvinylidene chloride sheets, polystyrene sheets, and styrene/acrylonitrile copolymer sheets. Examples of the paper include printing paper and coated paper. The thickness of the substrate of the image receiving sheet is usually in a range of from 10 to 400 $\mu$m, and preferably in a range of from 25 to 200 $\mu$m. In order to improve adhesion between the substrate and the receptor layer or between the substrate and the image forming layer of the thermal transfer sheet, the surface of the substrate may be treated by, for example, a glow discharge treatment or a corona discharge treatment.

As stated previously, it is preferable to form one, or two or more, receptor layers on the substrate in order to improve the transfer and fixation of the image forming layer to the surface of the image receiving sheet. The receptor layer is mainly composed of an organic polymer as a binder, which is preferably a thermoplastic resin. Examples of the resin include: homopolymers or copolymers of acrylic monomers such as acrylic acid, methacrylic acid, acrylates, and methacrylates; cellulosic polymers such as methyl cellulose, ethyl cellulose, and cellulose acetate; vinyl-based homopolymers and copolymers such as polystyrene, polyvinylpyrrolidone, polyvinyl butyral, and polyvinyl alcohol; polymers formed by polycondensation such as polyesters and polyamides; rubber-based polymers such as butadiene/styrene copolymers. In order to obtain an appropriate bonding strength between the receptor layer and the image forming layer, the binder of the receptor layer is preferably a polymer whose glass transition temperature (Tg) is 90° C. or below. In addition, it is preferable to add a plasticizer to the receptor layer in order to adjust the glass transition temperature of the receptor layer.

After the image is transferred to an image receiving sheet, if the image is to be further transferred to, for example, printing paper prepared separately, it is desired to produce at least one layer of the receptor layer, particularly the uppermost layer, from a light-hardenable material. For example, a composition of the light-hardenable material may comprise: (a) a photopolymerizable monomer comprised of at least one compound selected from a polyfunctional vinyl compound and a polyfunctional vinylidene compound, which are each capable of forming a photopolymerized material by an addition polymerization; (b) a binder composed of an organic polymer; and (c) a photopolymerization initiator, and optionally, additive agents such as a thermal polymerization inhibitor. Examples of the polyfunctional vinyl compound and the polyfunctional vinylidene compound include: polyol esters of unsaturated acids, particularly, acrylic acid or methacrylic acid such as ethylene glycol diacrylate, glycerin triacrylate, ethylene glycol dimethacrylate, 1,3-propanediol dimethacrylate, polyethylene glycol dimethacrylate, 1,2,4-butanetriol trimethacrylate, trimethylolethane triacrylate, pentaerythritol dimethacrylate, pentaerythritol trimethacrylate, pentaerythritol tetramethacrylate, pentaerythritol diacrylate, pentaerythritol triacrylate, pentaerythritol tetraacrylate, dipentaerythritol polyacrylate, 1,3-propanediol diacrylate, 1,5-pentanediol dimethacrylate, bisacrylate and bismethacrylate of polyethylene glycol having a molecular weight in a range of from 200 to 400); unsaturated amides, particularly unsaturated amides made from acrylic acid or methacrylic acid and containing an $\alpha$, $\omega$-diamine, wherein the alkylene chain of the unsaturated amide may have carbon-atom spacing, and ethylene-bismethacrylamide. In addition to these compounds, also usable is a polyester acrylate produced by condensing an ester made from a polyhydric alcohol and a polyvalent organic acid, with acrylic acid or methacrylic acid.

A suitable example of the binder composed of an organic polymer is the aforementioned thermoplastic resin as a binder for the receptor layer. The weight ratio of the photopolymerizable monomer to the binder composed of an organic polymer is ordinarily in a range of from 0.1:1.0 to 2.0:1.0. Suitable as the photopolymerization initiator is a photopolymerization initiator whose light absorption range is inside the near-ultraviolet light region and outside the visible light region (alternatively, a photopolymerization initiator that only slightly absorbs light in the visible light region). Examples of the photopolymerization initiator include: aromatic ketones such as benzophenone, Michler's ketone [4,4'-bis(dimethylamino)benzophenone], 4-methoxy-4'-dimethylaminobenzophenone, 2-ethylanthraquinone, and phenanthraquinone; benzoin; benzoin ethers such as benzoin methyl ether, benzoin ethyl ether, and benzoin phenethyl ether; benzoins such as methylbenzoin and ethylbenzoin; a dimer of 2-(o-chlorophenyl)-4,5-diphenylimidazole; and a dimer of 2-(o-chlorophenyl)-4,5-(m-methoxyphenyl)imidazole. The photopolymerization initiator is used usually in an amount ranging from 0.1 to 20 parts by weight based on 100 parts by weight of the photopolymerizable monomer.

A laminate of the thermal transfer sheet and the image receiving sheet of the present invention can be easily produced by a process comprising: stacking the thermal transfer sheet and the image receiving sheet so that an image forming layer side of the thermal transfer sheet faces an image receiving side (receptor layer side) of the image receiving sheet; and passing the stack through a pressing and heating roller. The heating temperature is preferably 130° C. or below, and more preferably 100° C. or below.

An imaging process by using the thermal transfer sheet of the present invention is explained below. The imaging process using the thermal transfer sheet of the present invention comprises the following steps: preparing an imaging laminate, which is formed by laminating an image receiving sheet to the image forming layer of the thermal transfer sheet; image-wise irradiating sequentially a surface of the laminate with laser light; and then peeling the thermal transfer sheet from the image receiving sheet. In this way, an image receiving sheet having the laser-irradiated region of the image forming layer transferred thereto is obtained. Lamination of the thermal transfer sheet and the image receiving sheet may be performed immediately before irradiation with the laser light. The irradiation with the laser light is usually carried out in the following procedure: that is, the image receiving sheet side of the imaging laminate is tightly adhered to a surface of a recording drum (rotatable drum whose inside is equipped with a vacuum-forming mechanism and whose surface is provided with a large number of fine openings) with vacuum suction; and then the outside, i.e., a thermal transfer sheet side, is irradiated with the laser light. For the purpose of irradiation, a surface is scanned with the laser light such that the laser light repeats back-and-forth movements in a drum-width direction while the drum is rotated at a fixed angular speed during the irradiation operation.

Examples of the laser light include a direct laser light. The direct laser light include: a gas laser light such as an argon ion laser light, helium/neon laser light, and helium/cadmium laser light; a solid-state laser light such as a YAG laser light; a semiconductor laser light; dye laser light; and excimer laser light. In addition, also usable is a light produced by halving a wavelength of an above-mentioned laser light through a secondary harmonics element. In the imaging process using the thermal transfer sheet of the present invention, from a standpoint of output power, ease in modulation, and the like, it is preferable to use a semiconductor laser. Further, in the imaging process using the thermal transfer sheet of the present invention, it is preferable to radiate the laser light such that the beam diameter on the light-to-heat conversion layer is in a range of from 5 to 50 μm (particularly preferably, in a range of from 6 to 30 μm). The scanning speed is preferably 1 m/second or greater, and particularly preferably 3 m/second or greater.

The imaging process using the thermal transfer sheet of the present invention can be used not only for formation of a black mask or a monochromatic image but also for formation of a multicolor image, in an advantageous way. In the imaging process using the thermal transfer sheet of the present invention, a multicolor image can be formed by, for example, a process comprising the following steps: separately preparing 3 (3 colors of) or 4 (4 colors of) imaging laminates which have image forming layers containing coloring agents of different colors; irradiating each of the laminates with the laser light in conformity with digital data based on an image obtained by a color-separation filter; separating the image transfer sheet from the image receiving sheet thus forming a color-separation image of a single color on each of the image receiving sheets; and then sequentially laminating the color-separation images onto an actual substrate prepared separately, such as printing paper or the like.

EXAMPLES

Example 1

1) Preparation of a coating liquid to form a light-to-heat conversion layer

A coating liquid to form a light-to-heat conversion layer was prepared by blending the following components by means of a stirrer.

Composition of coating liquid

| | in parts by weight |
|---|---|
| Infrared light-absorbing dye (NK-2014 manufactured by Nippon Kanko Shikiso Co., Ltd.) | 10 |
| Binder (Rikacoat SN-20 manufactured by New Japan Chemical) | 200 |
| N-methyl-2-pyrrolidone | 2000 |
| Surfactant (Megafac F-177 manufactured by Dainippon Ink and Chemicals Inc.) | 1 |

2) Formation of a light-to-heat conversion layer on a substrate

The coating liquid was coated on one side of a 100 μm thick polyethylene terephthalate film by means of a rotating coating device (wheeler) and a coating layer was then dried for 2 minutes in an oven kept at 100° C. In this way, a light-to-heat conversion layer was formed on the substrate. The light-to-heat conversion layer thus obtained exhibited an absorption peak at about 830 nm in a wavelength range of from 700 to 1000 nm. The absorbance (optical density : OD) was found to be OD=1.0 according to measurements with a Macbeth densitometer. The thickness of the layer was found to be 0.3 μm on average, according to observation of the cross-section with a scanning electron microscope.

3) Preparation of a coating liquid to form a yellow image forming layer

The following components were dispersed by means of a paint shaker (manufactured by TOYO SEIKI SEISAKUSHO, Ltd.) for 2 hours, and then the glass beads were removed. In this way, a yellow pigment dispersion base was prepared.

| Composition of pigment dispersion base | in parts by weight |
|---|---|
| 20 weight % solution of polyvinyl butyral (Denka Butyral No. 2000-L, having a Vicat softening point of 57° C. and manufactured by Denki Kagaku Kogyo Co., Ltd.) | 12.6 |
| Coloring material [yellow pigment (C.I. PY.14)] | 24 |
| Dispersing aid (Solsperse S-20000 manufactured by ICI Japan Ltd.) | 0.8 |
| n-propyl alcohol | 110 |
| glass beads | 100 |

A coating liquid to form a yellow image forming layer was prepared by blending the following components by means of a stirrer.

| Composition of coating liquid | in parts by weight |
|---|---|
| Pigment dispersion base obtained above | 20 |
| n-propyl alcohol | 60 |
| Surfactant (Megafac F-176PF manufactured by Dainippon Ink and Chemicals Inc.) | 0.05 |

4) Formation of a yellow image forming layer on the light-to-heat conversion layer The coating liquid was coated for 1 minute on a surface of the light-to-heat conversion layer by means of a wheeler, and a coating layer was then dried for 2 minutes in an oven kept at 100° C. In this way, a yellow image forming layer (comprising 64.2% by weight of pigment and 33.7% by weight of polyvinyl butyral) was formed on the light-to-heat conversion layer. The absorbance (optical density : OD) of the image forming layer thus obtained was found to be OD=0.7 according to measurements with a Macbeth densitometer. The thickness of the layer was found to be 0.4 μm on average according to the same method as above. According to the procedure described above, a thermal transfer sheet, was obtained, comprising the substrate, and the light-to-heat conversion layer and the yellow image forming layer disposed on the substrate in that order.

Example 2

1) Preparation of a coating liquid to form a light-to-heat conversion layer

A coating liquid to form a light-to-heat conversion layer was prepared by repeating the procedure of Example 1, except that the following components were blended by means of a stirrer.

| Composition of coating liquid | in parts by weight |
|---|---|
| Infrared light-absorbing dye (NK-2014, manufactured by Nippon Kanko Shikiso Co., Ltd.) | 10 |

-continued

| Composition of coating liquid | in parts by weight |
|---|---|
| Binder (Rikacoat PN-20 manufactured by New Japan Chemical) | 200 |
| N-methyl-2-pyrrolidone | 2000 |
| Surfactant (Megafac F-177 manufactured by Dainippon Ink and Chemicals Inc.) | 1 |

2) Preparation of a coating liquid to form a heat-sensitive peelable layer

A coating liquid to form a heat-sensitive peelable layer was prepared by blending the following components by means of a stirrer.

| Composition of coating liquid | in parts by weight |
|---|---|
| Nitrocellulose (Type HIG120 manufactured by Asahi Chemical Industry Co., Ltd.) | 1 |
| Methyl ethyl ketone | 20 |
| Propylene glycol monomethyletheracetate | 30 |
| Toluene | 70 |
| Surfactant (Megafac F-177PF manufactured by Dainippon Ink and Chemicals Inc.) | 0.014 |

3) Formation of a heat-sensitive peelable layer on the light-to-heat conversion layer The coating liquid was coated for 1 minute on the light-to-heat conversion layer disposed on the substrate by means of a wheeler, and a coating layer was then dried for 2 minutes in an oven kept at 100° C. In this way, a heat-sensitive peelable layer was formed on the light-to-heat conversion layer. The thickness of the heat-sensitive peelable layer was found to be 0.1 μm on average according to observation of the cross-section with a scanning electron microscope.

4) Formation of a yellow image forming layer on the heat-sensitive peelable layer The same liquid to form a yellow image forming layer as in Example 1 was coated for 1 minute on a surface of the heat-sensitive peelable layer by means of a wheeler, and a coating layer was then dried for 2 minutes in an oven kept at 100° C. In this way, a yellow image forming layer (having a thickness of 0.4 μm according to the same method as in Example 1 by a scanning electron microscope) was formed on the heat-sensitive peelable layer. The absorbance (optical density: OD) of the image forming layer thus obtained was found to be OD=0.7 according to measurements with a Macbeth densitometer. According to the procedure described above, a thermal transfer sheet was obtained, comprising the substrate, and the light-to-heat conversion layer, the heat-sensitive peelable layer, and the yellow image forming layer disposed on the substrate in that order.

Comparative Example 1

A thermal transfer sheet comprising a substrate, and a light-to-heat conversion layer, a heat-sensitive peelable layer, and a yellow image forming layer disposed on the substrate in that order, was obtained by repeating the procedure of Example 2, except that the liquid used to form the light-to-heat conversion layer had the following composition.

| Composition of coating liquid | in parts by weight |
|---|---|
| Infrared light-absorbing dye (NK-2014 manufactured by Nippon Kanko Shikiso Co., Ltd.) | 10 |
| Binder (Polyamide acid PAA-A, having a Tg of 200° C. and manufactured by Mitsui Chemicals, Inc.) | 160 |
| Methyl ethyl ketone | 1000 |
| 1-methoxy-2-propanol | 1000 |
| Surfactant (Megafac F-177 manufactured by Dainippon Ink and Chemicals Inc.) | 1 |

The polyamide acid PAA-A (obtained by a reaction between an aromatic tetracarboxylic acid dianhydride and a diamine) was a 25% by weight solution in N,N-dimethylacetamide.

Comparative Example 2

A thermal transfer sheet comprising a substrate, and a light-to-heat conversion layer, a heat-sensitive peelable layer, and a yellow image forming layer disposed on the substrate in that order, was obtained by repeating the procedure of Example 2, except that the liquid used to form the light-to-heat conversion layer had the following composition.

| Composition of coating liquid | in parts by weight |
|---|---|
| Infrared light-absorbing dye (NK-2014 manufactured by Nippon Kanko Shikiso Co., Ltd.) | 10 |
| Binder (Dianal BR-80, having a Tg of 105° C. and manufactured by Mitsubishi Rayon Co., Ltd.) | 160 |
| Methyl ethyl ketone | 1000 |
| 1-methoxy-2-propanol | 1000 |
| Surfactant (Megafac F-177 manufactured by Dainippon Ink and Chemicals Inc.) | 1 |

Comparative Example 3

A thermal transfer sheet comprising a substrate, and a light-to-heat conversion layer, a heat-sensitive peelable layer, and a yellow image forming layer disposed on the substrate in that order, was obtained by repeating the procedure of Example 2, except that the liquid used to form the light-to-heat conversion layer had the following composition.

| Composition of coating liquid | in parts by weight |
|---|---|
| Infrared light-absorbing dye (NK-2014 manufactured by Nippon Kanko Shikiso Co., Ltd.) | 10 |
| Binder (MPR-TSL-2, having a Tg of 70° C. and manufactured by NISSIN Chemical Industry Co., Ltd.) | 160 |
| Methyl ethyl ketone | 1000 |
| 1-methoxy-2-propanol | 1000 |
| Surfactant (Megafac F-177 manufactured by Dainippon Ink and Chemicals Inc.) | 1 |

<Preparation of an image receiving sheet>

1) Preparation of a coating liquid to form a first receptor layer

A coating liquid to form a first receptor layer was prepared by blending the following components by means of a. stirrer.

| Composition of coating liquid | in parts by weight |
|---|---|
| Polyvinyl chloride (Zeon 25 manufactured by Nippon Zeon Co., Ltd.) | 9 |
| Surfactant (Megafac F-177P manufactured by Dainippon Ink and Chemicals Inc.) | 0.1 |
| Methyl ethyl ketone | 130 |
| Toluene | 35 |
| Cyclohexanone | 20 |
| Dimethylformamide | |

2) Formation of a first receptor layer on a substrate

The coating liquid was coated on one side of a substrate (i.e., a 75 $\mu$m thick polyethylene terephthalate film) by means of a wheeler, and a coating layer was then dried for 2 minutes in an oven kept at 100° C. In this way, a first receptor layer (having a thickness of 1 $\mu$m) was formed on the substrate.

3) Preparation of a coating liquid to form a second receptor layer

A coating liquid to form a second receptor layer was prepared by blending the following components by means of a stirrer.

| Composition of coating liquid | in parts by weight |
|---|---|
| Methyl methacrylate/ethyl acrylate/methacrylic acid copolymer (Dianal BR-77 manufactured by Mitsubishi Rayon Co., Ltd.) | 17 |
| Alkyl acrylate/alkyl methacrylate copolymer (Dianal BR-64 manufactured by Mitsubishi Rayon Co., Ltd.) | 17 |
| Pentaerythritol tetraacrylate (A-TMMT manufactured by Shin Nakamura Kagaku Co., Ltd.) | 22 |

-continued

| Composition of coating liquid | in parts by weight |
|---|---|
| Surfactant (Megafac F-177P manufactured by Dainippon Ink and Chemicals Inc.) | 0.4 |
| Methyl ethyl ketone | 100 |
| Hydroquinone monomethylether | 0.05 |
| 2,2-dimethoxy-2-phenylacetophenone | 1.5 |

4) Formation of a second receptor layer on the first receptor layer

The coating liquid obtained was coated on a surface of the first receptor layer by means of a wheeler, and a coating layer was then dried for 2 minutes in an oven kept at 100° C. In this way, a second receptor layer (having a thickness of 26 μm) was formed on the first receptor layer. According to the procedure described above, an image receiving sheet was obtained comprising the substrate and the two receptor layers disposed thereon.

<Preparation of a laminate>

A laminate was prepared by laminating the second receptor layer of the image receiving sheet to the image forming layer of the thermal transfer sheet.

<Evaluation>

1) Measurement of sensitivity

The laminate obtained was fixed to a rotatable drum, whose inside was equipped with a vacuum forming mechanism and whose surface was provided with a number of fine openings for suction, by winding the laminate around the drum such that the image receiving sheet side contacted the surface of the drum and then creating a vacuum inside the drum. Then, the drum was rotated, and a surface of the laminate on the drum was irradiated with a semiconductor laser light having a wavelength of 830 nm so that the light was focused to a spot having a diameter of 7 μm on a surface of the light-to-heat conversion layer. Laser-recording (of image line) on the laminate was performed by moving the light spot in a direction at a right angle (supplementary scanning) to the direction of the rotation of the drum (a principal scanning direction). Conditions for the laser radiation were are follows.

Laser power: 110 mW

Principal scanning speed: 4 m/second

Pitch of supplementary scanning (amount of supplementary scan per rotation): 20 μm The laminate, after being laser-recorded, was removed from the drum, and then the thermal transfer sheet was removed manually from the image receiving sheet. Only a laser-irradiated region of the image forming layer was found to have been transferred from the thermal transfer sheet to the image receiving sheet. Observation of the transferred image under an optical microscope confirmed the recording in line-form in the laser-irradiated region. Then, the width of a recorded line was measured and the sensitivity was obtained according to the following equation. The results are shown in Table 1.

Sensitivity=(Laser power P) / (line width d×line speed v)

2) Evaluation of fogging

Solid images were recorded according to the above-described recording procedure, except that the pitch of supplementary scanning was 10 μm so that the beam lines overlapped each other. A fogging level of a yellow color of the transferred image was visually evaluated according to the following criteria:

⊚: free of fogging

○: good

Δ: insignificant fogging x: orange-colored fogging xx: green-colored fogging

The results are shown in Table 1.

3) Measurement of spectrum

The spectroscopic absorption spectra of the thermal transfer sheet in a range of from 300 to 900 were measured and the ratio $I_1/I_2$ of the absorbance $I_1$ at 830 nm to the absorbance $I_2$ at 400 nm was obtained. The results are shown in Table 1.

TABLE 1

| | Kinds of binders | Tg of binders | Temperature at which 5% weight loss occurs | Sensitivity | Fogging level (visual inspection) | $I_1/I_2$ |
|---|---|---|---|---|---|---|
| Example 1 | SN-20 | 295° C. | 510 | 300 mJ | ⊚ | ~0 |
| Example 2 | PN-20 | 265° C. | 485 | 350 mJ | ○ | 0.10 |
| Comparative example 1 | PAA-A | 200° C. | ~400 | 400 mJ | Δ | 0.34 |
| Comparative example 2 | Dianal BR-80 | 105° C. | ~180 | 700 mJ | x | 0.63 |
| Comparative example 3 | MPR-TSL-2 | 70° C. | ~100 Gradual decomposition | 450 mJ | xx | 0.65 |

As can be seen from the results of Table 1, if the light-to-heat conversion layer comprises the polyimide resin, the transfer of the light-to-heat conversion layer, which transfer results from the decomposition of the light-to-heat conversion layer, or the sublimation or decomposition of the IR dye, does not occur. Accordingly, a good transferred image, free of defects such as reduction in sensitivity and fogging, can be obtained. On the other hand, if the light-to-heat conversion layer comprises a binder having a low Tg as in the Comparative Examples, significant fogging is observed.

What is claimed is:

1. An image forming method comprising the steps of:

a step for preparing a thermal transfer sheet comprising a substrate and a light-to-heat conversion layer containing a substance capable of converting light to heat and a binder, the binder being a polyimide resin and soluble in an organic solvent, and an image forming layer, which are disposed on the substrate;

preparing an image receiving sheet comprising a substrate and a receptor layer;

overlaying the image receiving sheet onto the thermal transfer sheet;

irradiating imagewisely the light-to-heat conversion layer with light such that the image forming layer is imagewisely separable from the light-to-heat conversion layer; and transferring the image forming layer to the image receiving sheet to form an irreversible image thereon.

2. An image forming method according to claim 1, wherein the polyimide resin soluble in an organic solvent is a polyimide resin of which 5 parts or more by weight dissolves in N-methylpyrrolidone at 25° C.

3. An image forming method according to claim 1, wherein the glass transition temperature of the polyimide resin soluble in an organic solvent is in a range of from 200° C. to 400° C.

4. An image forming method according to claim 1, wherein the temperature at which 5% weight loss of the polyimide resin soluble in an organic solvent occurs is 450° C. or higher.

5. An image forming method according to claim 1, wherein the substance capable of converting light to heat is carbon black.

6. An image forming method according to claim 1, wherein the substance capable of converting light to heat is an organic dye.

7. An image forming method according to claim 1, wherein the image forming layer comprises a pigment in an amount that is 30 to 70% by weight and an amorphous, organic polymer with a softening point in a range from 40 to 150° C. in an amount that is 70 to 30% by weight, wherein the thickness of the image forming layer is in a range of from 0.2 to 1.5 $\mu$m.

8. An image forming method according to claim 1, wherein, the binder in the light-to-heat conversion layer soluble in an organic solvent has a structure represented any of the following formulae (I), (II), (III) and (IV):

(I)

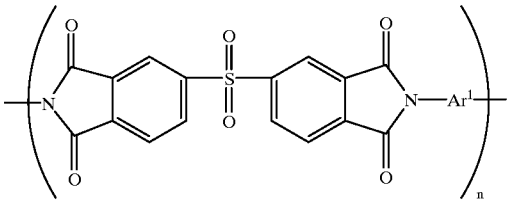

(II)

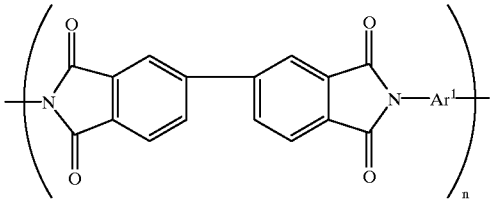

wherein $Ar^1$ represents an aromatic group represented by any of the following formulae (1)–(3); and n is an integer of from 10 to 100:

(1)

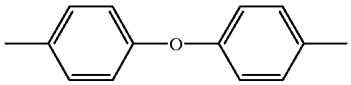

(2)

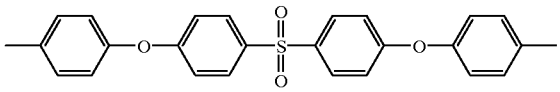

(3)

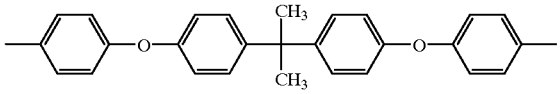

(III)

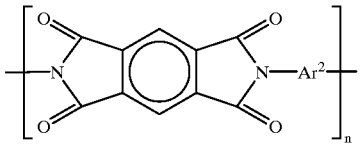

(IV)

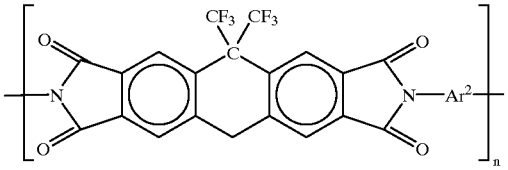

wherein $Ar^2$ represents an aromatic group represented by any formulae (4)–(7); and n is an integer of from 10 to 100:

(4)

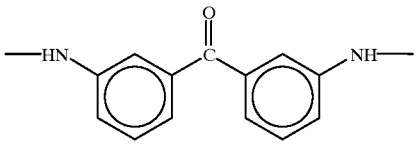

(5)

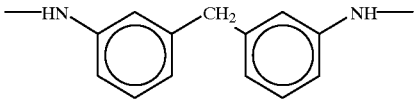

(6)

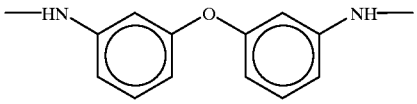

(7)

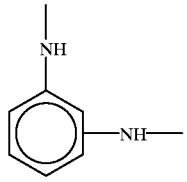

9. An image forming method according to claim 8, wherein the glass transition temperature of the polyimide resin soluble in an organic solvent is in a range of from 200° C. to 400° C.

10. An image forming method according to claim 8, wherein the temperature at which 5% weight loss of the polyimide resin soluble in an organic solvent occurs is 450° C. or higher.

11. An image forming method according to claim 8, wherein the image forming layer comprises a pigment in an amount that is 30 to 70% by weight and an amorphous, organic polymer with a softening point in a range 40 to 150° C. in an amount that is 70 to 30% by weight, wherein the thickness of the image forming layer is in a range of from 0.2 to 1.5 $\mu$m.

12. An image forming method according to claim 1, wherein, the binder in the light-to-heat conversion layer soluble in an organic solvent has a structure represented any of the following formulae (V), (VI) and (VII):

(V)

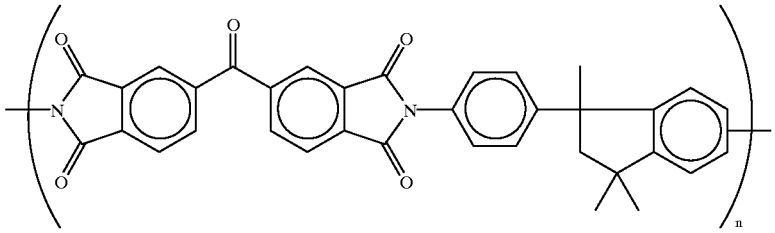

(VI)

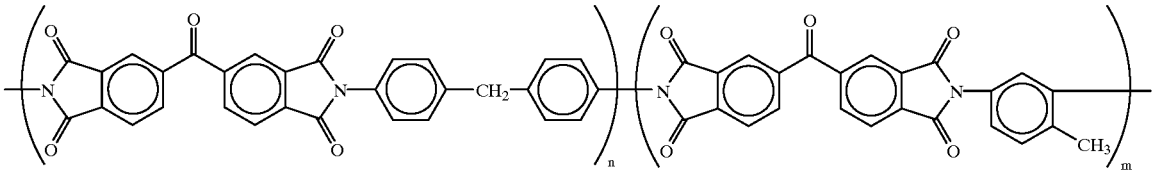

(VII)

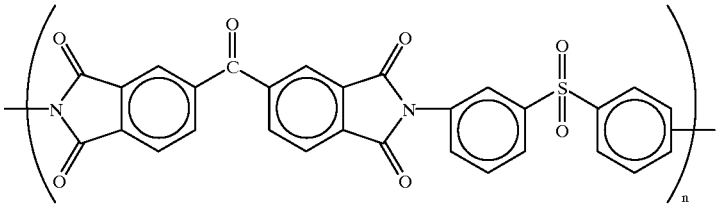

wherein n and m represent integers from 10 to 100, and the ratio n:m is in the range from 6:4 to 9:1.

13. An image forming method comprising the steps of:

a step for preparing a thermal transfer sheet comprising a substrate and a light-to-heat conversion layer containing a substance capable of converting light to heat and a binder, the binder being a polyimide resin and soluble in an organic solvent, a heat-sensitive peelable layer and an image forming layer, which are disposed on the substrate in this order;

preparing an image receiving sheet comprising a substrate and a receptor layer;

overlaying the image receiving sheet onto the thermal transfer sheet;

irradiating imagewisely the light-to-heat conversion layer with light such that the image forming layer is imagewisely separable from the light-to-heat conversion layer; and transferring the image forming layer to the image receiving sheet to form an irreversible image thereon.

14. An image forming method according to claim 13, wherein the temperature at which 5% weight loss of the polyimide resin soluble in an organic solvent occurs is 450° C. or higher.

15. An image forming method according to claim 13, wherein the image forming layer comprises a pigment in an amount that is 30 to 70% by weight and an amorphous, organic polymer with a softening point in a range from 40 to 150° C. in an amount that is 70 to 30% by weight, wherein the thickness of the image forming layer is in a range of from 0.2 to 1.5 $\mu$m.

16. An image forming method according to claim 13, wherein the binder in the light-to-heat conversion layer soluble in an organic solvent has a structure represented any of the following formulae (I), (II), (III) and (IV):

(I)

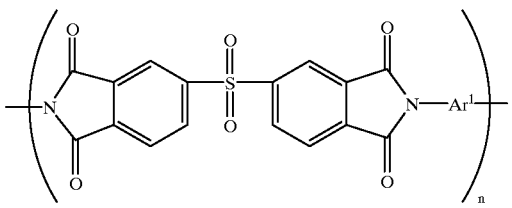

-continued
(II)
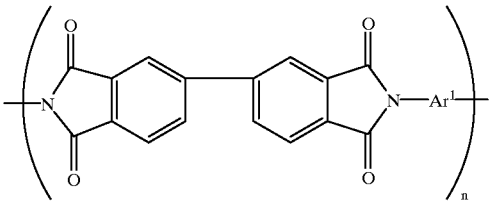
wherein $Ar^1$ represents an aromatic group represented formulae (1)–(3); and n is an integer of from 10 to 100:
(3)
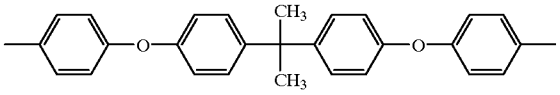
(III)
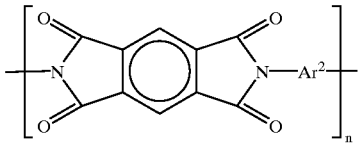
(IV)
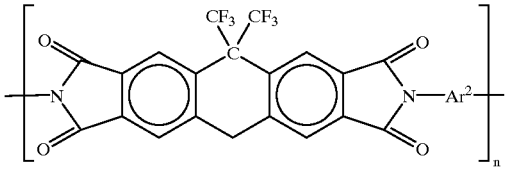
wherein $Ar^2$ represents an aromatic group represented by any of the following formulae (4)–(7); and n is an integer of from 10 to 100:
(4)
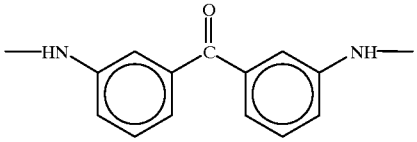
(5)
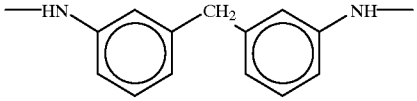
(6)
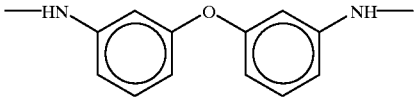
(7)
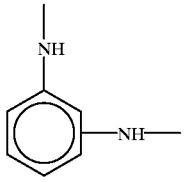
* * * * *